US006952983B2

(12) United States Patent
Ludwig et al.

(10) Patent No.: US 6,952,983 B2
(45) Date of Patent: Oct. 11, 2005

(54) POWER DRIVE-IN TOOL

(75) Inventors: Mnfred Ludwig, Landsberg (DE); Markus Looser, Weilheim (DE); Bernhard Liebert, Pfaffenhofen a.d. Glonn (DE); Thomas Hofbrucker, Mammendorf (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/775,809

(22) Filed: Feb. 9, 2004

(65) Prior Publication Data

US 2004/0216563 A1 Nov. 4, 2004

(30) Foreign Application Priority Data

Feb. 7, 2003 (DE) ..... 103 05 041

(51) Int. Cl.[7] ..... B25B 17/00; B25B 23/02; B25B 23/04; B25B 23/06

(52) U.S. Cl. ..... 81/57.37; 81/434; 227/107

(58) Field of Search ..... 81/57.37, 57.4, 81/434, 435; 227/107, 119, 135, 138, 139; 1145/52

(56) References Cited

U.S. PATENT DOCUMENTS

| | | | | |
|---|---|---|---|---|
| 3,186,616 A | | 6/1965 | Weems | |
| 3,965,950 A | * | 6/1976 | MacDonald | 81/455 |
| 5,897,045 A | * | 4/1999 | Olvera et al. | 227/119 |

FOREIGN PATENT DOCUMENTS

| | | | |
|---|---|---|---|
| GB | 0704991 | | 3/1954 |
| GB | 704991 | * | 3/1954 |

* cited by examiner

*Primary Examiner*—Joseph J. Hail, III
*Assistant Examiner*—Alvin J. Grant
(74) *Attorney, Agent, or Firm*—Abelman, Frayne & Schwab

(57) ABSTRACT

A power drive-in tool (4) for use in a stand-up tool includes a holding device (16) arranged in a front, in a drive-in direction, section of the drive-in tool and in which a fastening element (18) can be automatically received and released, a guide (6) for the fastening element (18) associated with the driving-tool (4) and connected to the holding device (16) by a feed track (7), an intermediate securing device (20) located in the feed track (7) and in which the fastening element (18) is held before being fed toward the holding device (16) and which is provided with a side stop displaceable into the feed track (7).

9 Claims, 6 Drawing Sheets

2
8
II
14
6
28
III
26
7
25
24
64
18
18
20
4
23
22
10
7
12
II
14
16

POWER DRIVE-IN TOOL

BACKGROUND OF THE INVENTION

1. Field of the Invention

The present invention relates to a power drive-in tool, in particular for use in a stand-up tool, and including a driving-in-tool for driving in a fastening element, a holding device arranged in a front, in a drive-in direction, section of the drive-in tool and in which the fastening element can be automatically received and released, a guide for the fastening element associated with the drive-in tool, a feed track connecting the fastening element guide with the holding device, an intermediate securing device located in the feed track and in which the fastening element is held before being fed toward the holding device.

2. Description of the Prior Art

In known stand-up tools, fastening elements are fed from a fastening element guide. The fastening elements, which are arranged in the fastening element guide, are separated and are fed to a feed tube. Along the feed tube, fastening elements slide into the holding device that can be formed, e.g., by a jaw unit. In the holding device, the fastening element is held in the operational direction of the drive-in tool. For driving the fastening element in, the holding device opens automatically.

In order to feed a fastening element to a feed tube at a correct point of time, there is provided an intermediate securing device. In the intermediate securing device, a fastening element is held, after being separated, until it is released by the intermediate securing device at a point of time at which the holding device is ready to receive it.

U.S. Pat. No. 5,897,045 discloses a stand-up tool with a fastening element guide which is arranged on a separating device.

After being separated, the fastening element is fed to a feed tube. On the feed tube, an intermediate securing device is arranged. The intermediate securing device is formed of a magnetized wall region of the feed tube. The fastening element is held on the wall region until it is pushed away from the magnetized wall by an ejector upon the stand-up tool being pressed against an object. The fastening element then slides through a conventional feed tube toward a holding device in which it is held until being driven in.

A drawback of a conventional intermediate securing device consists in that with fastening elements having a sidewise projection head, e.g., screws or bolts, in particular when such fastening elements are provided with an integrated washer, the axis of the fastening element, which is held in the intermediate securing device, extend at an angle to the direction of the feed tube.

This often results in that upon being released from the intermediate securing device, the fastening element is rotated upon being displaced in the ejection direction. This can lead to jamming of the fastening element, or to feeding of the fastening element to the holding device with a wrong end. In addition, during an operation of the tool, vibrations can occur at a point of time at which a separated fastening element should be secured on the magnetized wall portion. Moreover, it is possible that the magnetic effect of the wall region is not sufficient, because of dust or the like contaminants, to hold the fastening element on the wall portion. This can lead to premature sliding of the fastening element into the feed tube and, thereby, to an error functioning.

Accordingly, an object of the present invention is to provide a stand-up tool with an intermediate securing device in which the above-mentioned drawbacks are eliminated and a reliable operation of the tool is insured.

SUMMARY OF THE INVENTION

This and other objects of the present invention, which will become apparent hereinafter, are achieved by providing, on the intermediate securing device, a side stop displaceable into the feed track between the fastening element guide and the intermediate securing device for blocking displacement of the fastening element back into the feed track from the intermediate securing device.

With the side stop, the fastening element is not any more secured in the intermediate securing device only in the direction of the holding device. Rather, it is insured that the fastening element cannot move back into the feed path in front of the fastening element guide. In particular, the side stop prevents the fastening element from particularly tilting into the feed path in front of the fastening element guide at the moment the fastening element is ejected from the intermediate securing device. Rather, the side stop provides a lateral support for the fastening element, insuring the ejection movement of the fastening element substantially in the axial direction.

Preferably, the side stop is formed by the separation device. Thereby, the side stop can be formed by already available parts.

According to an advantageous embodiment of the present invention, the side stop is formed by a slide. Forming a side stop as a slide insures a reliable adjustment of the side stop and provides for a simple separation of the fastening element.

Advantageously, the slide is displaced linearly. A linear movement can be executed in a simple manner and is rather stable. As a result, an operational reliability of the tool is increased without a noticeable increase in costs of production.

It is advantageous when the slide is operated by a part of the drive-in tool movable relative to the intermediate securing device. Thereby, the side stop can automatically and in a simple manner be displaced into the feed path and out therefrom.

Advantageously, the side stop is preloaded in its closing position in which it blocks the feed path, preventing the fastening element, which is secured in the intermediate securing device, from entering into the feed path. The preloading of the side stop increases its stability.

Advantageously, the slide pointedly extends in the closing direction. In this way, it is prevented that the fastening element jams when the side stop is displaced into the feed track. This insures a disturbance-free operation.

Preferably, the intermediate securing device has, in the direction of the holding device, an axial stop that can be displaced out of the feed path. This insures a reliable holding of the fastening element in the intermediate securing device. The axial stop prevents a premature feeding of a fastening element to the holding device and a resulting faulty operation.

Advantageously, the axial stop is formed of two stops displaceable out of the feed path against a biasing force. This provides for a simple and reliable way to open the axial stop.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
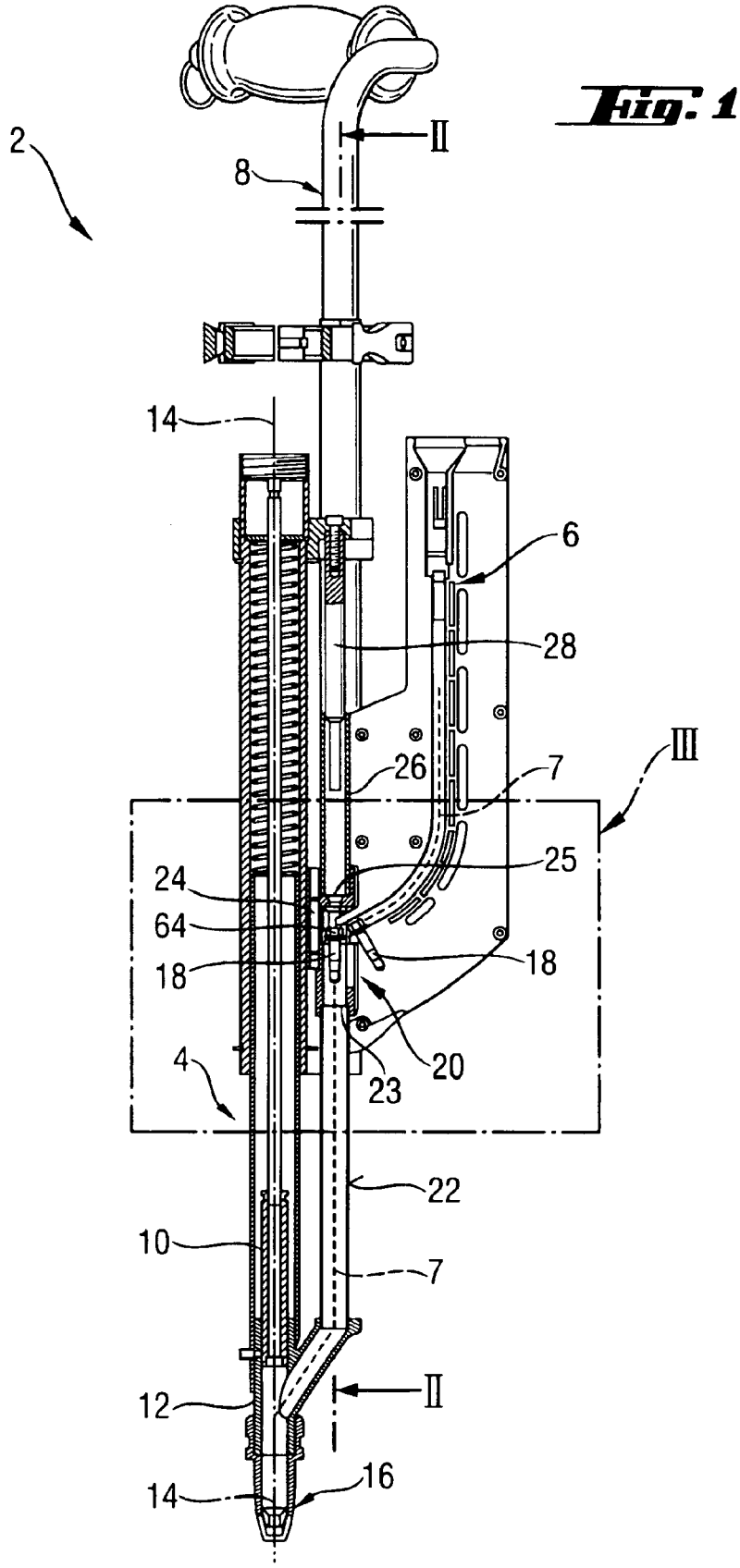
FIG. 1 a longitudinal cross-sectional view of a stand-up tool with a drive-in tool according to the present invention along line I—I in FIG. 2.
Figure 2:
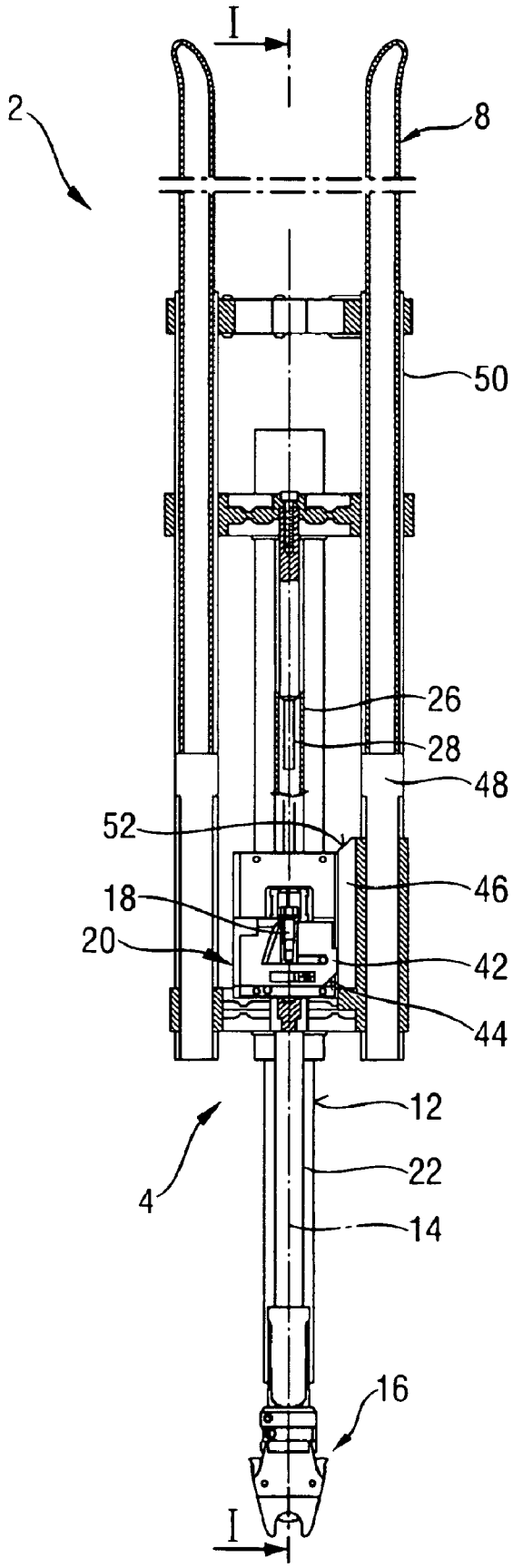
FIG. 2 a cross-sectional view along line II—II in FIG. 1.

A stand-up tool 2 according to the present invention, which is shown in FIGS. 1–2, includes a drive-in power tool 4, a guide 6 for fastening elements, and a handle 8. The drive-in tool 4 includes a driving-in tool 10 axially displaceable in a guide tube 12 along a drive-in axis 14. At the end of the guide tube 12 remote from the handle 8, there is provided a holding device 16.

The fastening element guide 6 is releasably secured on the drive-in tool 4. In a mounted condition of the fastening element guide 6, i.e., when the guide 6 is secured to the drive-in tool 4, the guide 6 is connected with the holding device 16 by a feed track 7 along which a fastening element 18 is conveyed to the holding device 16.

The feed track 7 from the fastening element 6 to the holding device 16 extends over an intermediate securing device 20, a feed tube 22, and a section of the guide tube 12 adjacent to the driving-in tool 10. The intermediate securing device 20 has a housing 24 that adjoins, at its lower end 23, the feed tube 22, and at its upper end 25 adjacent to the handle 8, a tubular discharge guide 26. The housing 24 is open at both opposite ends 23, 25. In the discharge guide 26, a piston-shaped ejector 28 is displaceably arranged. The ejector 28 is displaceable in the axial direction of the feed tube 22 relative to the intermediate securing device 20.

The intermediate securing device 20 is shown in detail in FIGS. 3–7. The housing 24 of the intermediate securing device 20 has, at its side facing toward the fastening element guide 6, a side entrance opening 30 provided with a slide 32. The slide 32 reciprocates in the movement direction 38 and is displaced by a guide pin 34 and/or a guide nose 36 provided on the housing 24. The reciprocation of the slide 32 permits to at least partially close the entrance opening 30 (See FIGS. 6–7) or open it (See FIGS. 4–5). A spring force SF, which is shown symbolically, acts on the slide 32, displacing the same along the movement direction 38 into a position in which the entrance opening 30 is open. The slide 32 is provided with an opening 40 that overlaps the entrance opening 30 in the open position of the slide 32.

On the slide 32, there is provided an operational region 42 that partially extends beyond the remaining portion of the slide 32 and forms an inclined contact region 44. The operational region 42 cooperates with an operating member 46 that is arranged on a lower extension piece 48 of a support tube 50 of the handle 8, as shown in FIG. 2. The operating member 46 has an inclined surface 52.

The intermediate securing element 20 includes, as shown in FIGS. 8–11, a jaw unit 54 formed of two cheeks 58 pivotable about a pin 56. The pin 56 extends parallel to the feed tube 22 secured to the intermediate securing device 20. The two cheeks 58 form a receiving space 60 therebetween. Each of the two cheeks 58 forms, at its opposite ends, respective stops 62 extending inward in form of a projection. The stops 62 narrow the receiving space 60 of the jaw unit 54 at its upper and lower ends.

Figure 8:
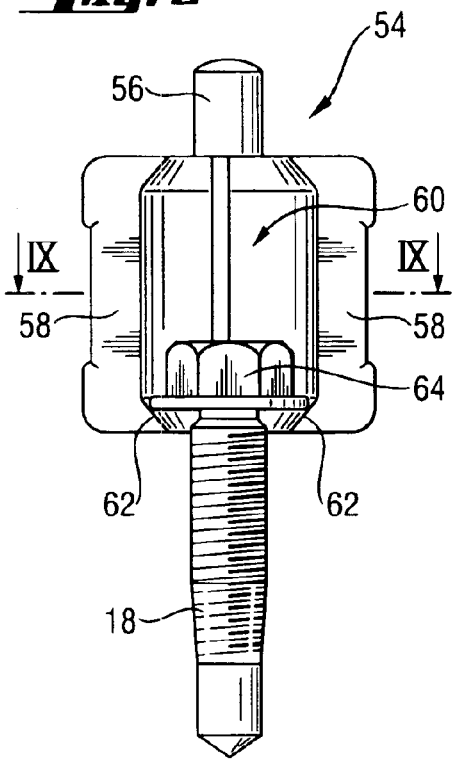
FIG. 8 a front elevational view of the jaw unit in its closed position.
Figure 10:
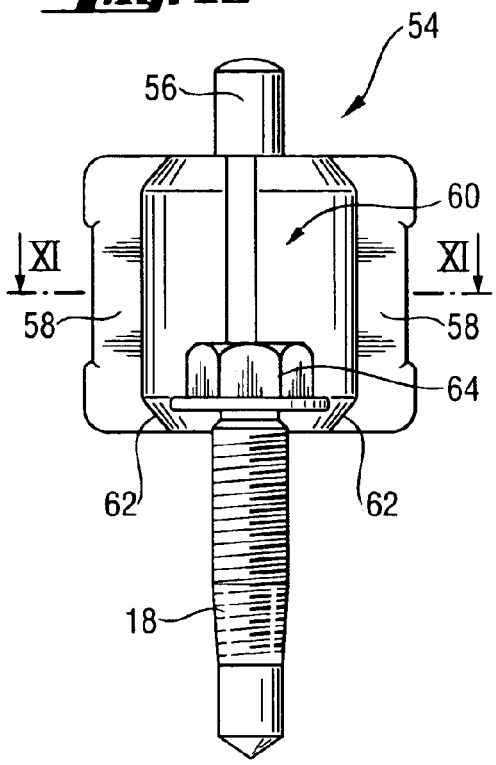
FIG. 10 a front elevational view of the jaw unit in its open position.
Figure 9:
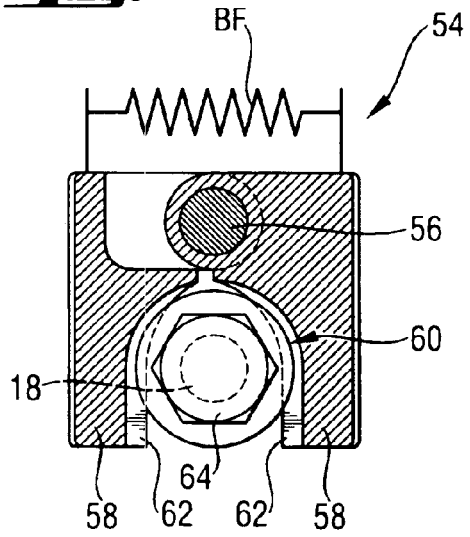
FIG. 9 a cross-sectional view along line IX—IX in FIG. 8.
Figure 11:
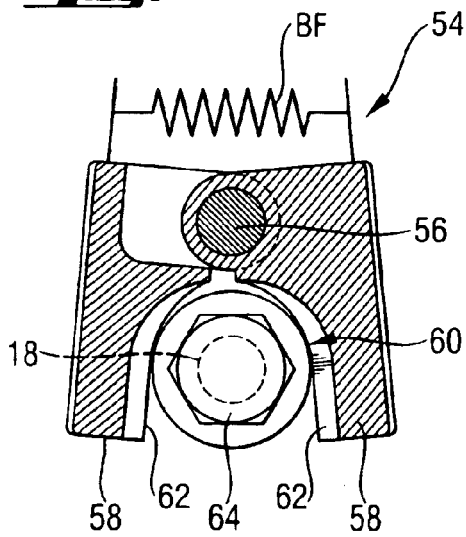
FIG. 11 a cross-sectional view along line XI—XI in FIG. 10.

As shown in FIGS. 8–9, a head of a fastening element 18 is received in the receiving space 60 of the jaw unit 54, with the fastening element 18 being secured downwardly in the direction of action of a gravity force. With the ejector 28 (FIG. 3) applying additional pressure to the head 64 of the fastening element 18, the cheeks 58 pivot away from each other until the lower stops 62 are spaced so far from each other that the head 64 can slide through (FIGS. 10-11). The cheeks are preloaded, in their closed position, by a spring force BF, as shown symbolically in FIGS. 9 and 11, retaining the fastening element 18 in the direction of the gravity force.

During assembly of the stand-up tool 2, the fastening element guide 6, which is filled with fastening elements 18, is mounted on the drive-in tool 4.

Figure 3:
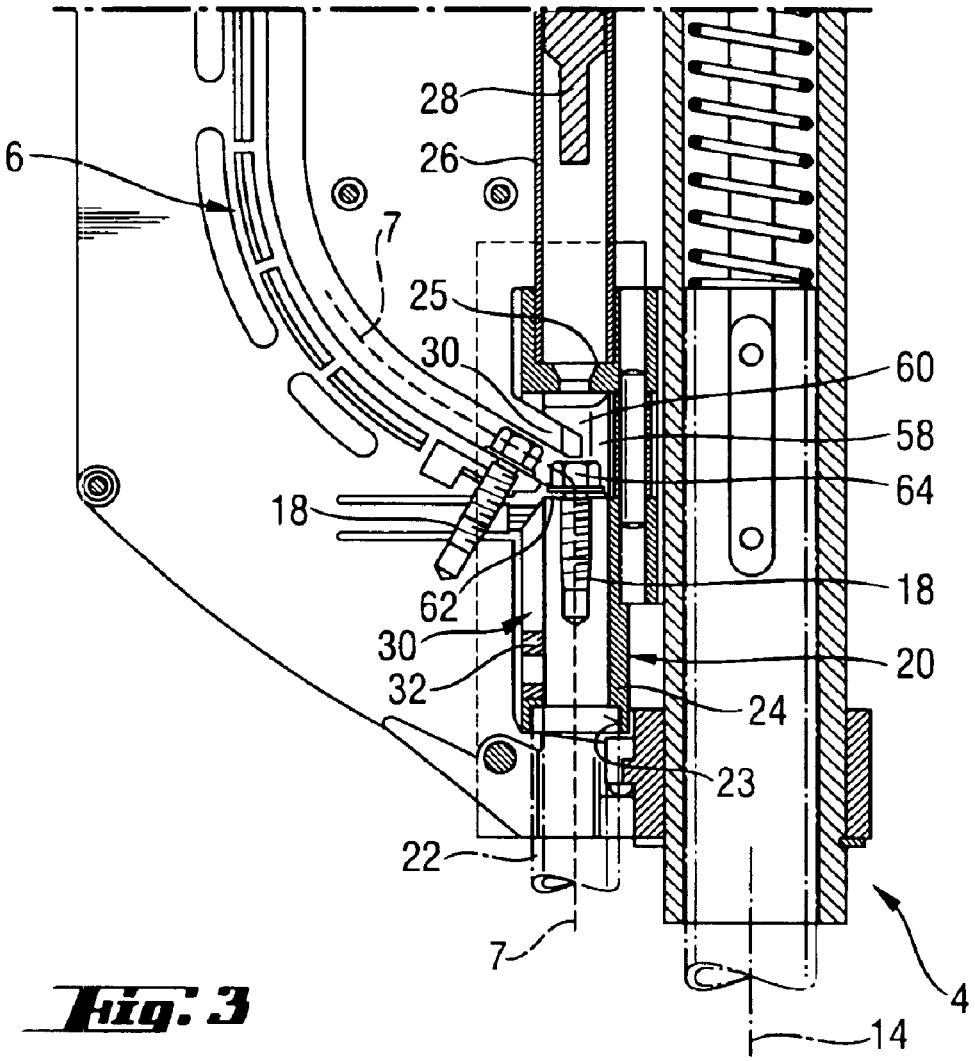
FIG. 3 a bottom cross-sectional view of a region III in FIG. 1 showing the intermediate securing device with the fastening element guide.
Figure 5:
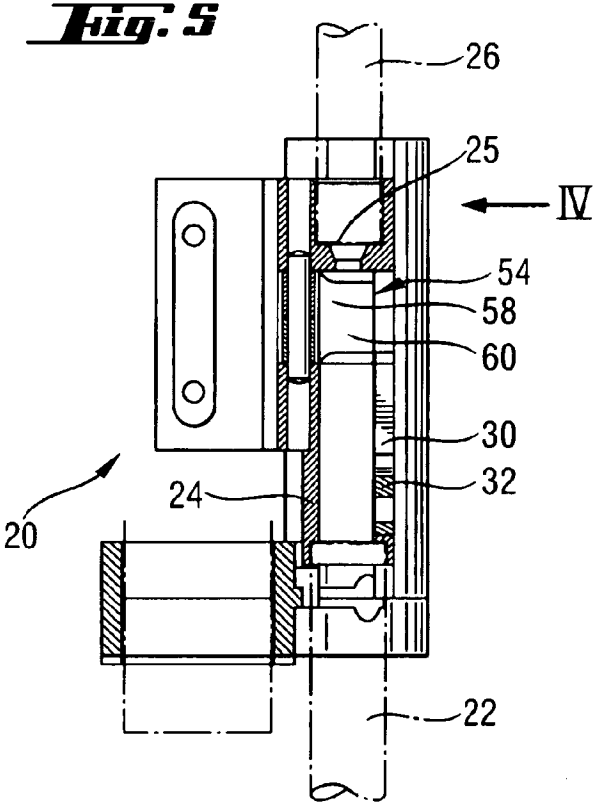
FIG. 5 a cross-sectional view along line V—V in FIG. 4.
Figure 4:
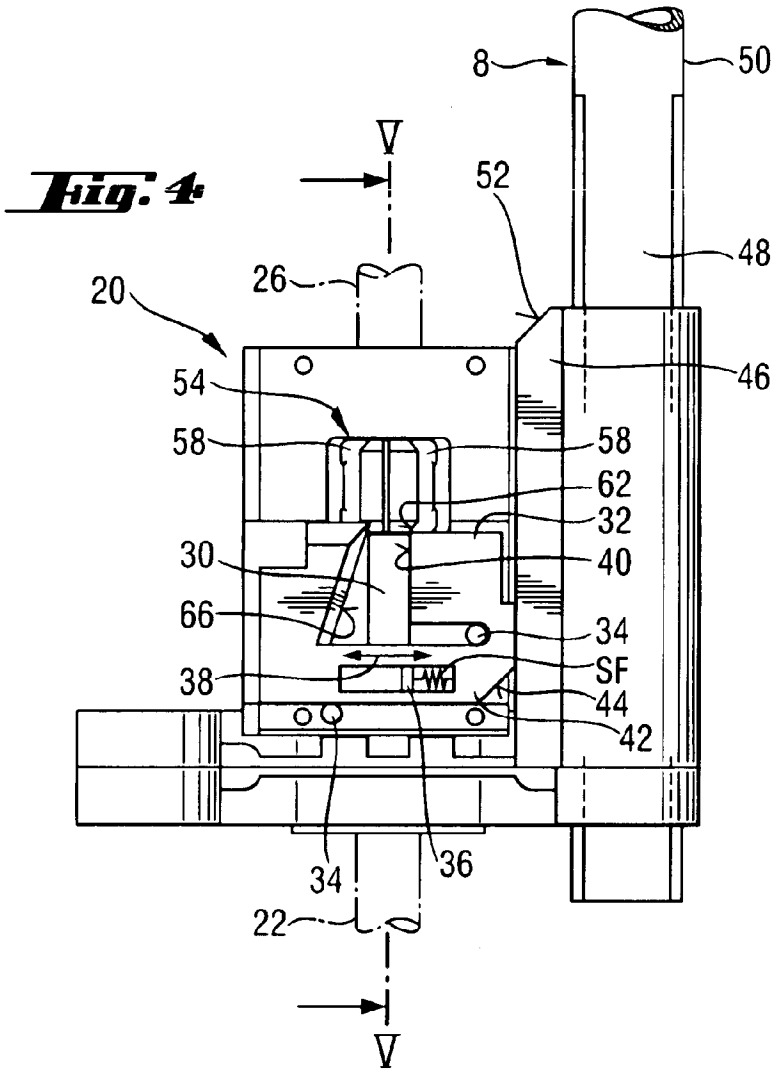
FIG. 4 a front view of the intermediate securing device with the slide in its open position.
Figure 7:
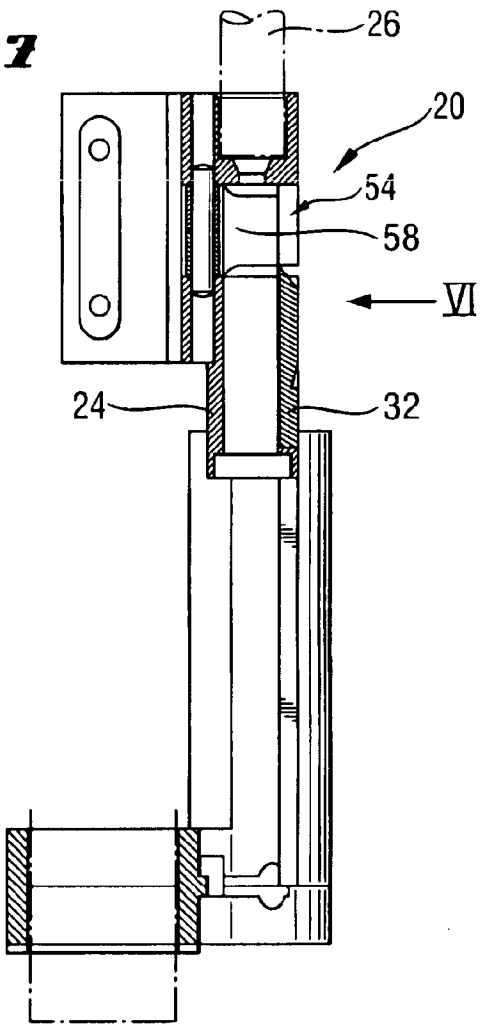
FIG. 7 a cross-sectional view along line VII—VII in FIG. 6.
Figure 6:
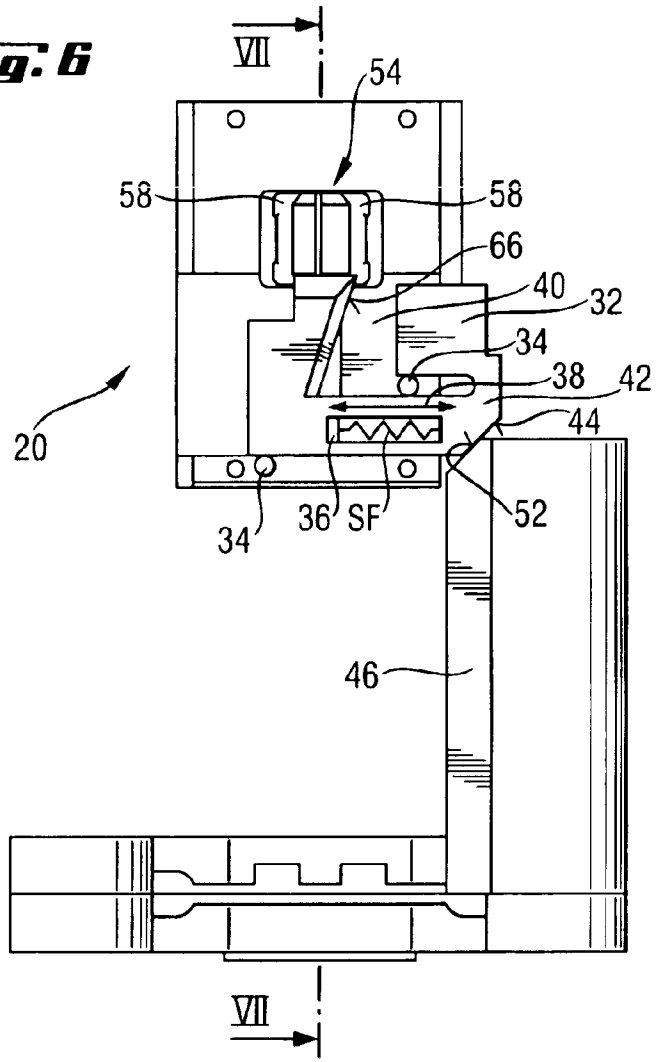
FIG. 6 a front view of the intermediate securing device with the slide in its closed position.

As long as an operator does not apply any pressure in the direction of the drive-in axis 14 on the handle 8, the operating member 46 occupies a position shown in FIGS. 2 and 4, at a height of the operational region 42, and presses the slide 32 against the spring force SF into a position in which the slide opening 40 overlaps the entrance opening 30 of the intermediate securing device 20. As a result, as shown in FIG. 3, the fastening element 18 can slide downward, under the action of the gravity force, out of the fastening element guide 6 through the entrance opening 30 into the intermediate securing device 20. The head 64 of the fastening element 18 slides into the receiving space 60 of the jaw unit 54 and lies on the lower stops 62 in the direction of the gravity force, with the cheeks 58 being brought in their closing position under the action of the spring force BF. In this way, the fastening element 18, which extends in the direction of the gravity force toward the lower end of the intermediate securing device 20 which the feed tube 22 adjoins, is held in the intermediate securing device 20.

As soon as the operator applies pressure, via the handle 8, to the lower end of the drive-in tool 4 in the direction of the drive-in axis 14, the support tube 50 of the handle 8, together with the extension piece 48 and the operating member 46, are displaced downwardly relative to the intermediate securing device 20. As soon as the inclined surface 52 reaches the height of the contact region 44 of the operational region 42 of the slide 32, the slide 32 begins to move, under the action of spring force SF, in the movement direction 38 toward the operational region 42. When the slide 32 reaches, upon moving in the movement direction 38, a stop region 66, which extends pointedly to the movement direction 38 and is located between the fastening element 18 in the intermediate securing device 20 and an adjacent fastening element 18, it at least partially closes the entrance opening 30 of the intermediate securing device 20.

By this time, the ejector 28 is pushed with the handle 8 into the discharge guide 26 in the direction of the intermediate securing device 20. The ejector 28 penetrates, at the end of its movement, into the open end 25 of the housing 24 of the intermediate securing device 20 and applies pressure to the head 64 of the fastening element 18 held in the intermediate securing device. The stop 66, which closes the entrance opening 30 prevents the fastening element 18 from extending into the entrance opening 30. Rather, the fastening element 18, upon being engaged by the ejector 28, is supported radially from all slides by the slide 32, which functions as a side stop, and by the jaw unit 54.

Upon additional pressure being applied to the head 64 of the fastening element 18, the cheeks 58, which up to this time acted as a stop in a direction toward the feed tube 22, are pressed away from each other against a spring force BF until the head 64 slides between the lower stops 62 of the jaw unit 54 and falls in the direction of the gravity force into the feed tube 22.

Through the feed tube 22, the fastening element 18 is fed to the lower section of the guide tube 12 until it reaches the holding device 16. The fastening element 18 is held in the holding device 16 in the direction of the drive-in axis until it is attached to an object by a driving-in tool 10 in a following setting process.

As soon as the operator releases the pressure applied to the handle 8, the operating member 46, together with the support tube 50 is displaced relative to the intermediate securing device 20, in a direction toward the handle-side, upper end of the drive-in tool 4. As a result, the inclined surface 52 of the operating member 46 contacts the inclined contact region 44 of the operational region 42 of the slide 32 (See FIG. 6) and presses the slide 32 against the spring force SF in its open position in which the slide opening 42 overlaps the entrance opening 30 of the intermediate securing device 20. In this way, the feed path 7 from the fastening element guide 6 to the intermediate securing device 20 for a fastening element 18 is open again. The lowermost fastening element 18 is now able to slide, in the direction of action of the gravity force, from the fastening element guide 6 into now again closed, jaw unit 54 of the intermediate securing device 20.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A power drive-in tool (4) for use in a stand-up tool (2), comprising a driving-in tool (10) for driving in a fastening element (18); a holding device (16) arranged in a front, in a driving direction, section of the drive in tool and in which the fastening element (18) can be automatically received and released; a guide (6) for the fastening element (18) associated with the drive-in tool (4); a feed track (7) connecting the fastening element guide (6) with the holding device (16); intermediate securing means (20) located in the feed track (7) and in which the fastening element (18) is held before being fed toward the holding device (16); and a side stop provided on the intermediate securing means (20) and displaceable into the feed track (7) for blocking displacement of the fastening element (18) from the intermediate securing means (20) back into the section of feed track between the fastening element guide and the intermediate securing means; and an ejector (28) penetratable into the intermediate securing means (20) for ejecting element (18) out of the intermediate securing means.

2. A power drive-in tool according to claim 1, wherein the side stop is formed by separation means.

3. A power drive-in tool according to claim 1, wherein side stop is formed by a slide (32).

4. A power drive-in tool according to claim 3, wherein the slide (32) is linearly displaceable.

5. A power drive-in tool according to claim 3, wherein the drive-in tool (4) comprises a member displaceable relative to the intermediate securing means (20) for displacing the slide (32).

6. A power drive-in tool according to claim 1, further comprising means for preloading the side stop in a closing position thereof in which the stop extends into the feed path.

7. A power drive-in tool according to claim 1, wherein the side stop extends pointedly in a closing direction thereof.

8. A power drive-in tool according to claim 1, wherein the intermediate securing means (20) has, in a direction of the holding device (16), an axial stop displaceable out of the feed track (7).

9. A power drive-in tool according to claim 8, wherein the axial stop has at least two stops (62) displaceable out of the feed track (7) against action of a biasing force (BF).

* * * * *